US010803817B2

(12) United States Patent
Gao et al.

(10) Patent No.: US 10,803,817 B2
(45) Date of Patent: Oct. 13, 2020

(54) EMISSION CONTROL CIRCUIT, METHOD FOR DRIVING EMISSION CONTROL CIRCUIT, EMISSION CONTROLLER, AND DISPLAY DEVICE

(71) Applicant: Shanghai Tianma AM-OLED Co., Ltd., Shanghai (CN)

(72) Inventors: Yana Gao, Shanghai (CN); Xing Yao Zhou, Shanghai (CN); Yue Li, Shanghai (CN); Renyuan Zhu, Shanghai (CN); Dongxu Xiang, Shanghai (CN); Gaojun Huang, Shanghai (CN); Yilin Xu, Shanghai (CN); Zhonglan Cai, Shanghai (CN); Juan Zhu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 158 days.

(21) Appl. No.: 16/103,021

(22) Filed: Aug. 14, 2018

(65) Prior Publication Data

US 2019/0304382 A1 Oct. 3, 2019

(30) Foreign Application Priority Data

Apr. 2, 2018 (CN) ..... 2018 1 0283620

(51) Int. Cl.
*G09G 3/3258* (2016.01)
*G09G 3/36* (2006.01)

(52) U.S. Cl.
CPC ..... *G09G 3/3607* (2013.01); *G09G 3/3674* (2013.01); *G09G 3/3685* (2013.01); *G09G 2310/0267* (2013.01)

(58) Field of Classification Search
None
See application file for complete search history.

(56) References Cited

U.S. PATENT DOCUMENTS

2018/0090072 A1* 3/2018 Sun ..... G09G 3/3233

FOREIGN PATENT DOCUMENTS

CN 103927965 A 7/2014

* cited by examiner

*Primary Examiner* — Carl Adams
(74) *Attorney, Agent, or Firm* — Tarolli, Sundheim, Covell & Tummino LLP

(57) ABSTRACT

The present disclosure provides an emission control circuit including a first processing module, a second processing module, a third processing module and an output module. The first processing module generates a first signal in response to a first control signal, a second control signal and a second signal. The second processing module includes a first transistor having a control electrode electrically connected to the first node, a first electrode electrically connected to the second node and a second electrode electrically connected to the first control signal terminal, and a second transistor having a control electrode electrically connected to the first control signal terminal, a first electrode electrically connected to the second node and a second electrode electrically connected to the first control signal terminal. The third processing module generates a third signal and a fourth signal in response to the second control signal, the first signal and the second signal.

14 Claims, 6 Drawing Sheets

EMISSION CONTROL CIRCUIT, METHOD FOR DRIVING EMISSION CONTROL CIRCUIT, EMISSION CONTROLLER, AND DISPLAY DEVICE

CROSS-REFERENCE TO RELATED APPLICATIONS

The present application claims priority to Chinese Patent Application No. 201810283620.9, filed on Apr. 2, 2018, the content of which is incorporated herein by reference in its entirety.

TECHNICAL FIELD

The present disclosure relates to display technology, and more particularly, to an emission control circuit, a method for driving the emission control circuit, an emission controller, and a display device.

BACKGROUND

A display device is provided with a plurality of cascaded emission control circuits. Each emission control circuit has an output terminal connected to an emission control signal line. When displaying an image, output terminals of the plurality of cascaded emission control circuits sequentially output emission control signals, which are transmitted to corresponding sub-pixels through the emission control signal lines for driving the sub-pixels to emit light.

As well-known in the art, the emission control circuit includes a plurality of transistors and a plurality of nodes. During the operation of the emission control circuit, potentials at respective nodes in the circuit would change. However, based on the specific structure of the emission control circuit in the related art, in the process when potentials at the nodes change, there would be a too big voltage difference between nodes connected to two terminals of a transistor. This could negatively affect stable operation of the transistor, and further negatively affect operation stability of the entire emission control circuit when it gets more serious, thereby resulting in that the image cannot be normally displayed.

SUMMARY

The present disclosure provides an emission control circuit and a method for driving the emission control circuit, an emission controller, and a display device, aiming to reduce a voltage difference between two terminals of a transistor in the emission control circuit and improve operation stability of the entire emission control circuit, thereby allowing an image to be displayed normally.

In a first aspect, the present disclosure provides an emission control circuit. The emission control circuit includes a first processing module, a second processing module, a third processing module, and an output module. The first processing module is electrically connected to an input signal terminal, a first control signal terminal, a second control signal terminal and a first voltage signal terminal and is configured to generate a first signal to be outputted to a first node in response to a first control signal, a second control signal and a second signal. The second processing module is electrically connected between the first control signal terminal and a second node and is configured to generate the second signal to be outputted to the second node in response to the first signal and the first control signal. The second processing module comprises a first transistor and a second transistor. The first transistor has a control electrode electrically connected to the first node, a first electrode electrically connected to the second node, and a second electrode electrically connected to the first control signal terminal. The second transistor has a control electrode electrically connected to the first control signal terminal, a first electrode electrically connected to the second node, and a second electrode electrically connected to the first control signal terminal. The third processing module is electrically connected to the second control signal terminal and the first voltage signal terminal and is configured to generate a third signal to be outputted to a third node and to generate a fourth signal to be outputted to a fourth node in response to the second control signal, the first signal and the second signal. The output module is electrically connected to the first voltage signal terminal, a second voltage signal terminal, and an emission control signal terminal and is configured to provide an emission control signal to the emission control signal terminal in response to the first signal and the fourth signal.

In a second aspect, the present disclosure provides a method for driving the emission control circuit according to the first aspect. The method includes: in a first period, providing a logic low level by the input signal terminal, providing a logic low level by the first control signal terminal, providing a logic high level by the second control signal terminal, providing, by the first processing module, a logic low level to the first node in response to the logic low level provided by the first control signal terminal, providing, by the second processing module, a logic low level to the second node by the first transistor of the second processing module responding to logic low level at the first node and the second transistor of the second processing module responding to the logic low level provided by the first control signal terminal, providing, by the third processing module, logic high level to the third node and providing logic high level to the fourth node in response to the logic low level at the first node and logic low level at the second node, and enabling, by the output module, the emission control signal terminal to output logic low level in response to the logic low level at the first node; in a second period, providing a logic low level by the input signal terminal, providing a logic high level by the first control signal terminal, providing a logic low level by the second control signal terminal, providing, by the second processing module, a logic high level to the second node by the first transistor of the second processing module responding to logic low level at the first node, providing, by the third processing module, a logic high level to the fourth node in response to the logic low level provided by the second control signal terminal and logic low level at the first node, and enabling, by the output module, the emission control signal terminal to keep outputting a logic low level in response to the logic low level at the first node; in a third period, providing a logic low level by the input signal terminal, providing a logic low level by the first control signal terminal, providing logic high level by the second control signal terminal, providing, by the first processing module, a logic high level to the first node in response to the logic low level provided by the first control signal terminal, providing, by the second processing module, a logic low level to the second node by the second transistor of the second processing module responding to the logic low level provided by the first control signal terminal, providing, by the third processing module, a logic high level to the third node in response to the logic low level at the second node, and the emission control signal terminal keeping outputting a logic low level; in a fourth period, providing a logic low level by the input signal terminal, providing a logic high level by the first control signal terminal, providing a logic low level by the second control signal terminal, providing, by the third processing module, a logic low level to the third node and providing a logic low level to the fourth node in response to a logic low level at the second node and the logic low level provided by the second control signal terminal, and enabling, by the output module, the emission control signal terminal to output a logic high level in response to the logic low level at the fourth node; in a fifth period, providing a logic low level by the input signal terminal, providing a logic low level by the first control signal terminal, providing a logic high level by the second control signal terminal, providing, by the first processing module, a logic low level to the first node in response to the logic low level provided by the first control signal terminal, providing, by the second processing module, a logic low level to the second node by the first transistor responding to the logic low level at the first node and the second transistor responding to the logic low level provided by the first control signal terminal, providing, by the third processing module, a logic high level to the third node and providing a logic high level to the fourth node in response to the logic low level at the second node and the logic low level at the first node, and enabling, by the output module, the emission control signal terminal to output a logic low level in response to the logic low level at the first node; and in a sixth period, providing a logic low level by the input signal terminal, providing a logic high level by the first control signal terminal, providing a logic low level by the second control signal terminal, providing, by the first transistor, a logic high level to the second node in response to the logic low level at the first node, providing, by the third processing module, a logic high level to the fourth node in response to the logic low level at the first node, and enabling, by the output module, the emission control signal terminal to keep outputting a logic low level in response to the logic low level at the first node.

In a third aspect, the present disclosure provides an emission controller. The emission controller includes a plurality of cascaded emission control circuits according to the first aspect.

In a fourth aspect, the present disclosure provides a display device. The display device includes the emission controller according to the third aspect.

BRIEF DESCRIPTION OF DRAWINGS

In order to more clearly illustrate technical solutions of embodiments of the present disclosure, the accompanying drawings used in the embodiments are briefly described below. The drawings described below are merely a part of the embodiments of the present disclosure. Based on these drawings, those skilled in the art can obtain other drawings without any creative effort.

DESCRIPTION OF EMBODIMENTS

In order to better understand technical solutions of the present disclosure, the embodiments of the present disclosure are described in detail with reference to the drawings. It should be clear that the described embodiments are merely part of the embodiments of the present disclosure rather than all of the embodiments. All other embodiments obtained by those skilled in the art without paying creative labor shall fall into the protection scope of the present disclosure.

The terms used in the embodiments of the present disclosure are only used for the purpose of describing particular embodiments and are not intend to limit the present disclosure. The words "a/an", "said" and "the" in the singular form used in the embodiments and the appended Claims of the present disclosure also intend to include the plural form, unless otherwise clearly indicated in the context.

It should be understood that the term "and/or" used in the context only indicates a related relation describing related objects and indicates that there may be three relations, for example A and/or B may indicates three conditions of: A only, both A and B, and B only. Furthermore, the character "/" in the context generally indicates an "or" relation of the previous and following related objects.

It should be understood that the embodiments of the present disclosure may use the terms "first", "second", "third", etc. to describe processing modules, these processing modules, however, should not be limited by these terms. These terms are only used for distinguishing the processing modules from each other. For example, without departing from the scope of the embodiments of the present disclosure, a first processing module may also be referred to as a second processing module, and similarly, a second processing module may also be referred to as a first processing module.

To better understand the technical solutions provided by the embodiments of the present disclosure, a structure of the display device will be firstly described in detail in the following.

Figure 1:
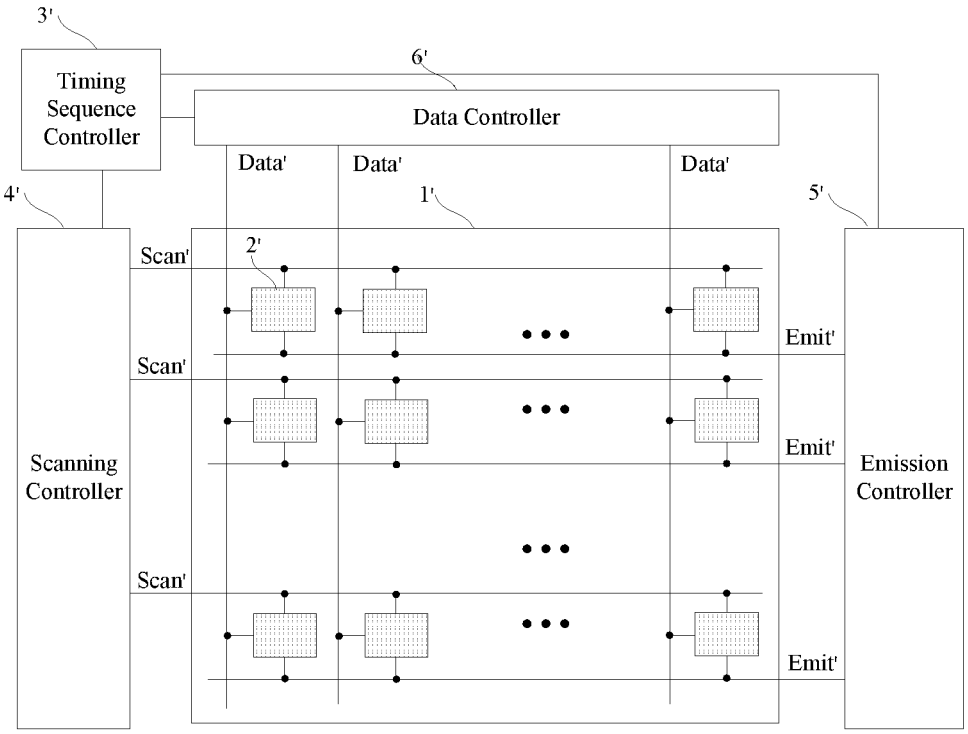
FIG. 1 is a structural schematic diagram of a display device provided in the related art.

As shown in FIG. 1, which is a structural schematic diagram of a display device in the related art, the display device includes a display panel 1'. A plurality of sub-pixels 2' is provided in the display panel 1' and is arranged in m rows and n columns. In addition, the display device further includes a timing sequence controller 3', a scanning controller 4', an emission controller 5', and a data controller 6'. The scanning controller 4' has m output terminals, each of which is connected to a row of sub-pixels 2' through a respective scanning line Scan'. The emission controller 5' includes m cascaded emission control circuits, each of which has an output terminal connected to a row of sub-pixels 2' through a respective emission control line Emit'. The data controller 6' has n output terminals, each of which is connected to a column of sub-pixels 2' through a respective data line Data'. The timing controller 3' is connected to the scanning controller 4', the emission controller 5', and the data controller 6', and is configured to provide a corresponding driving signal to the scan controller 4', the emission controller 5', and the data controller 6', respectively.

The timing controller 3' generates a first driving signal, a second driving signal, and a third driving signal in response to received control signals. The scanning controller 4' generates a scanning signal in response to the first control signal, and the scanning signal is sequentially applied to a first row of sub-pixels 2' to an $m^{th}$ row of sub-pixels 2' through the m scanning lines Scan'. The data controller 6' generates a data signal in response to the second control signal, and the data signal is applied to a first column of sub-pixels 2' to an $n^{th}$ row of sub-pixels 2' through the n data lines Data'. The m emission control circuits of the emission controller 5' sequentially generate respective emission control signals in response to a third control signal, and the emission control signals are applied to the first row of sub-pixels 2' to the $m^{th}$ row of sub-pixels 2' through the m emission control lines. When receiving the emission control signal, sub-pixels 2' in an $i^{th}$ row emit light under the effect of the data signals applied in advance, where i is a positive integer selected from a range of 1 to m.

Figure 2:
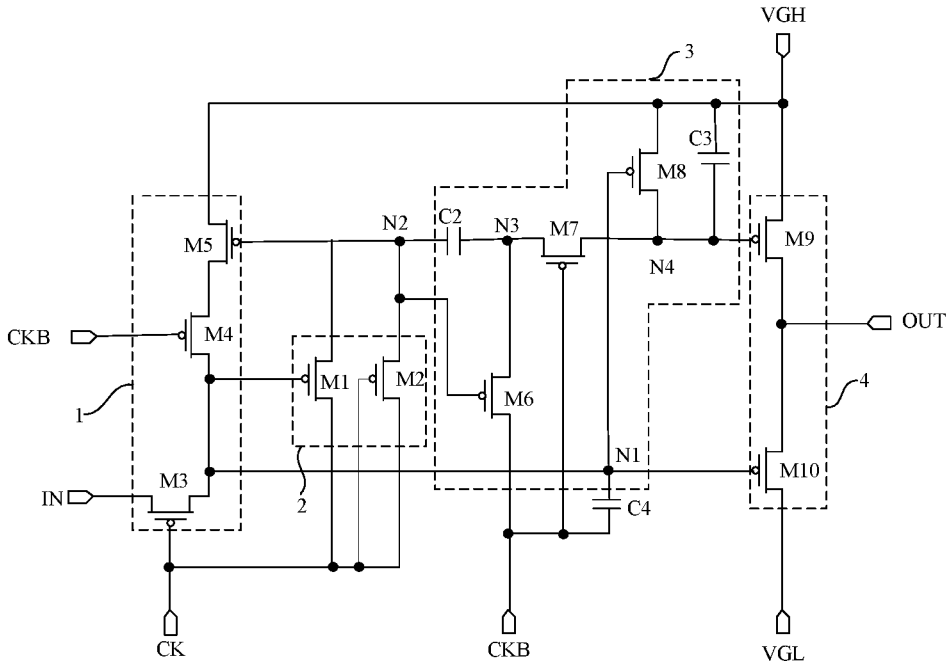
FIG. 2 is a structural schematic diagram of an emission control circuit according to an embodiment of the present disclosure.

According to an embodiment of the present disclosure, an emission control circuit is provided as shown in FIG. 2. FIG. 2 is a structural schematic diagram of an emission control circuit according to an embodiment of the present disclosure. The emission control circuit includes a first processing module 1, a second processing module 2, a third processing module 3, and an output module 4.

The first processing module 1 is electrically connected to an input signal terminal IN, a first control signal terminal CK, a second control signal terminal CKB and a first voltage signal terminal VGH. The first processing module 1 is configured to generate a first signal to be outputted to a first node N1 in response to a first control signal provided by the first control signal terminal CK, a second control signal provided by the second control signal terminal CKB and a second signal.

The second processing module 2 is electrically connected between the first control signal terminal CK and a second node N2. The second processing module 2 is configured to generate a second signal to be outputted to the second node N2 in response to the first signal and the first control signal. The second processing module 2 includes a first transistor M1 and a second transistor M2. The first transistor M1 has a control electrode electrically connected to the first node N1, a first electrode electrically connected to the second node N2 and a second electrode electrically connected to the first control signal terminal CK. The second transistor M2 has a control electrode electrically connected to the first control signal terminal CK, a first electrode electrically connected to the second node N2 and a second electrode electrically connected to the first control signal terminal CK.

The third processing module 3 is electrically connected to the second control signal terminal CKB and the first voltage signal terminal VGH. The third processing module 3 is configured to generate a third signal to be outputted to a third node N3 and generate a fourth signal to be outputted to a fourth node N4 in response to the second control signal, the first signal and the second signal.

The output module 4 is electrically connected to the first voltage signal terminal VGH, a second voltage signal terminal VGL, and an emission control signal terminal OUT. The output module 4 is configured to provide an emission control signal to the emission control signal terminal OUT in response to the first signal and the fourth signal.

The operating principle of the emission control circuit according to the embodiment of the present disclosure will be described in detail by referring to FIG. 3, which is a signal sequence diagram corresponding to FIG. 2.

Figure 3:
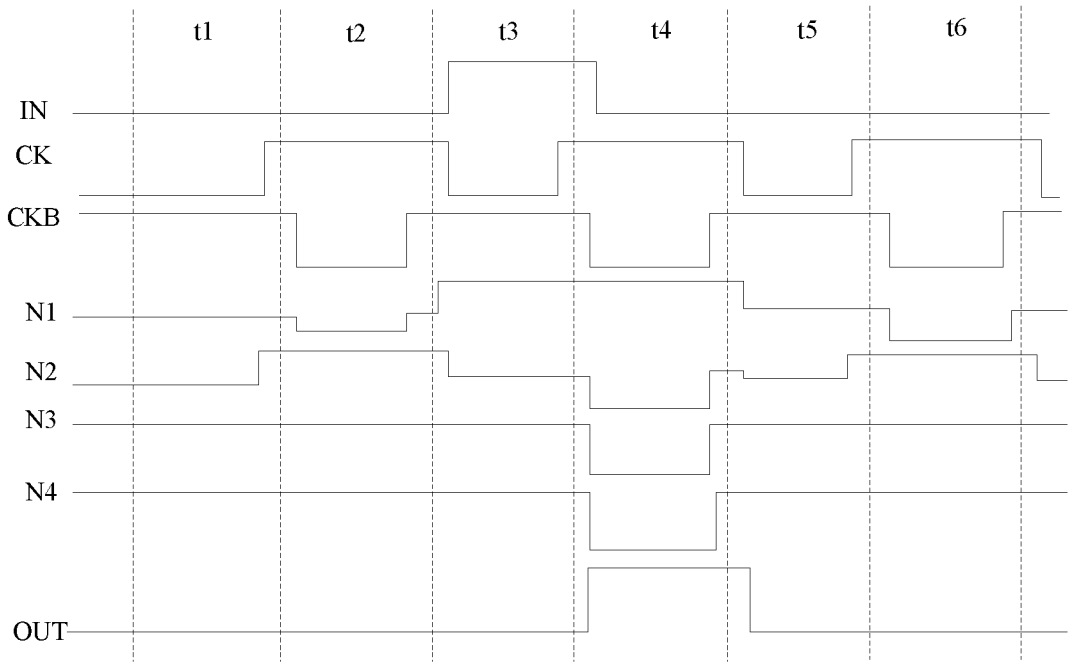
FIG. 3 is a signal sequence diagram corresponding to FIG. 2.

First of all, it should be noted that, for sake of understanding, FIG. 3 denotes signals provided by different signal terminals by using mark symbols of corresponding signal terminals. Similarly, signals received at different nodes are also denoted by using mark symbols of corresponding nodes.

Each emission control circuit has a driving cycle including a first period to a sixth period.

In a first period t1, the input signal terminal IN provides logic low level, the first control signal terminal CK provides logic low level, and the second control signal terminal CKB provides logic high level. The first processing module 1 provides logic low level to the first node N1 in response to the logic low level provided by the first control signal terminal CK. The second processing module 2 provides logic low level to the second node N2 by the first transistor M1 of the second processing module 2 responding to the logic low level at the first node N1 and the second transistor M2 of the second processing module 2 responding to the logic low level provided by the first control signal terminal CK. The third processing module 3 provides logic high level to the third node N3 and provides logic high level to the fourth node N4 in response to the logic low level at the first node N1 and the logic low level at the second node N2. The output module 4 keeps the emission control signal terminal OUT outputting logic low level in response to the logic low level at the first node N1.

In a second period t2, the input signal terminal IN provides logic low level, the first control signal terminal CK provides logic high level, and the second control signal terminal CKB provides logic low level. The second processing module 2 provides logic high level to the second node N2 by the first transistor M1 of the second processing module 2 responding to logic low level at the first node N1. The third processing module 3 provides logic high level to the fourth node N4 in response to the logic low level provided by the second control signal terminal CKB and the logic low level at the first node N1. The output module 4 enables the emission control signal terminal OUT to keep outputting logic low level in response to the logic low level at the first node N1.

In a third period t3, the input signal terminal IN provides logic low level, the first control signal terminal CK provides logic low level, and the second control signal terminal CKB provides logic high level. The first processing module 1 provides logic high level to the first node N1 in response to the logic low level provided by the first control signal terminal CK. The second processing module 2 provides logic low level to the second node N2 by the second transistor M2 of the second processing module 2 responding to the logic low level provided by the first control signal terminal CK. The third processing module 3 provides logic high level to the third node N3 in response to the logic low level at the second node N2. The emission control signal terminal OUT keeps outputting logic low level.

In a fourth period t4, the input signal terminal IN provides logic low level, the first control signal terminal CK provides logic high level, and the second control signal terminal CKB provides logic low level. The third processing module 3 provides logic low level to the third node N3 and provides logic low level to the fourth node N4 in response to logic low level at the second node N2 and the logic low level provided by the second control signal terminal CKB. The output module 4 enables the emission control signal terminal OUT to output logic high level in response to the logic low level at the fourth node N4.

In a fifth period t5, the input signal terminal IN provides logic low level, the first control signal terminal CK provides logic low level, and the second control signal terminal CKB provides logic high level. The first processing module 1 provides logic low level to the first node N1 in response to the logic low level provided by the first control signal terminal CK. The second processing module 2 provides logic low level to the second node N2 by the first transistor M1 responding to the logic low level at the first node N1 and the second transistor M2 responding to the logic low level provided by the first control signal terminal CK. The third processing module 3 provides logic high level to the third node N3 and provides logic high level to the fourth node N4 in response to the logic low level at the second node N2 and the logic low level at the first node N1. The output module 4 enables the emission control signal terminal OUT to output logic low level in response to the logic low level at the first node N1.

In a sixth period t6, the input signal terminal IN provides logic low level, the first control signal terminal CK provides logic high level, and the second control signal terminal CKB provides logic low level. The first transistor M1 provides logic high level to the second node N2 in response to logic low level at the first node N1. The third processing module 3 provides logic high level to the fourth node N4 in response to the logic low level at the first node N1. The output module 4 enables the emission control signal terminal OUT to keep outputting logic low level in response to the logic low level at the first node N1.

In the related art, the second transistor M2 in the emission control circuit generally has a second electrode electrically connected to the second voltage signal terminal VGL. It can be seen from the above description on the operating principle of the emission control circuit that in the sixth period t6, the first node N1 is at a potential of logic low level, the first transistor M1 is switched on under the effect of the logic low level at the first node N1 and then transmits the logic high level provided by the first control signal terminal CK to the second node N2, based on the connection mode in the related art. Then, since the second electrode of the second transistor M2 is electrically connected to the second voltage signal terminal VGL, this would lead to a big voltage difference between two terminals of the second transistor M2, thereby negatively affecting stability of the second transistor M2 and further resulting in damage to the second transistor M2 when it gets more serious.

In the emission control circuit according to the embodiments of the present disclosure, the second electrode of the second transistor M2 is electrically connected to the first control signal terminal CK. In this way, in the sixth period t6, although the second node N2 is at a potential of logic high level, the signal provided by the first control signal terminal CK is also at logic high level, thereby greatly reducing the voltage difference between two terminals of the second transistor M2. Therefore, with the emission control circuit according to the embodiments of the present disclosure, the present disclosure can effectively reduce a voltage difference between two terminals of a transistor in the emission control circuit, improve stability of the transistor and further improve operation stability of the entire emission control circuit, such that the image can be normally displayed.

Further, since the second electrode of the second transistor M2 and the second electrode of the first transistor M1 are both connected to the first control signal terminal CK in the emission control circuit according to the embodiments of the present disclosure, in layout design of the emission control circuit, the second electrode of the second transistor M2 can be electrically connected to the second electrode of the first transistor M1 adjacent to the second transistor M2 through one wiring, so as to achieve electrical connection between the second electrode of the second transistor M2 and the first control signal terminal CK. Compared to the related art, the use of the emission control circuit does not need to connect a wiring between the second electrode of the second transistor M2 and a second voltage signal terminal VGL far from the second transistor M2, thereby saving layout space occupied by such wiring.

In some embodiments, referring to FIG. 2 again, the first processing module 1 can include a third transistor M3, a fourth transistor M4 and a fifth transistor M5.

The third transistor M3 has a control electrode electrically connected to the first control signal terminal CK, a first electrode electrically connected to the first node N1, and a second electrode electrically connected to the input signal terminal IN. The third transistor M3 controls electrical connection between the first node N1 and the input signal terminal IN based on a first control signal applied to the third transistor M3.

The fourth transistor M4 has a control electrode electrically connected to the second control signal terminal CKB, a first electrode, and a second electrode electrically connected to the first node N1.

The fifth transistor M5 has a control electrode electrically connected to the second node N2, a first electrode electrically connected to the first voltage signal terminal VGH, and a second electrode electrically connected to the first electrode of the fourth transistor M4. The fifth transistor M5 controls electrical connection between the first voltage signal terminal VGH and the first electrode of the fourth transistor M4 based on a second signal applied to the second node N2.

In some embodiments, referring to FIG. 2 again, the third processing module 3 can include a sixth transistor M6, a seventh transistor M7, an eighth transistor M8, a storage capacitor C3 and a second capacitor C2.

The sixth transistor M6 has a control electrode electrically connected to the second node N2, a first electrode electrically connected to the third node N3, and a second electrode electrically connected to the second control signal terminal CKB. The sixth transistor M6 controls electrical connection between the third node N3 and the second control signal terminal CKB based on a second signal applied to the second node N2.

The seventh transistor M7 has a control electrode electrically connected to the second control signal terminal CKB, a first electrode electrically connected to the third node N3, and a second electrode electrically connected to the fourth node N4. The seventh transistor M7 controls electrical connection between the third node N3 and the fourth node N4 based on a second control signal applied to the seventh transistor M7.

The eighth transistor M8 has a control electrode electrically connected to the first node N1, a first electrode electrically connected to the first voltage signal terminal VGH, and a second electrode electrically connected to the fourth node N4. The eighth transistor M8 controls electrical connection between the first voltage signal terminal VGH and the fourth node N4 based on the first signal applied to the first node N1.

The storage capacitor C3 has a first electrode electrically connected to the first voltage signal terminal VGH and a second electrode electrically connected to the fourth node N4. The storage capacitor C3 is used to store the fourth signal of the fourth node N4, so as to maintain the fourth node at a normal potential. Therefore, the output module 4 can operate normally under the effect of the fourth signal.

The second capacitor C2 has a first electrode electrically connected to the second node N2 and a second electrode electrically connected to the third node N3. The second capacitor C2 is used to adjust a signal of the second node N2 based on a signal of the third node N3. For example, when entering the fourth period t4 from the third period t3, a potential at the third node N3 jumps from logic high level to logic low level, thereby resulting in a sharp fall. When a potential variation of the third node N3 is $\Delta V_{N3}$, a potential variation of the second node N2 is $$\Delta V'_{N4} = \frac{C_2}{C_2 + C_g} \times \Delta V_{N3},$$

where $C_2$ is a capacitance of the second capacitor C2 and $C_g$ is a parasitic capacitance. At this point, if the influence of the parasitic capacitance is ignored, the potential variation of the second node N2 is equal to the potential variation of the third node N3. Therefore, the potential at the second node N2 would be greatly pulled down by the potential at the third node N3.

Figure 4:
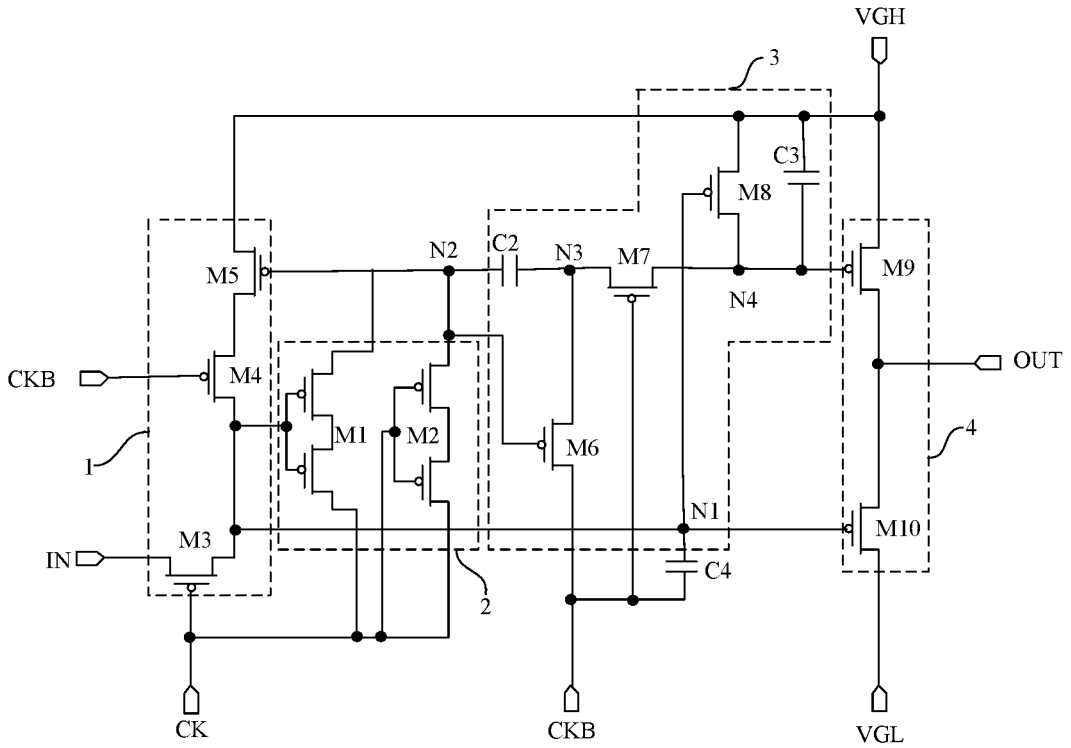
FIG. 4 is another structural schematic diagram of an emission control circuit according to an embodiment of the present disclosure.

However, since the first control signal terminal CK provides a signal of logic high level in the fourth period t4, when the potential at the second node N2 is greatly pulled down, this would lead to a big voltage difference between two terminals of the first transistor M1 and a big voltage difference between two terminals of the second transistor M2, thereby resulting in instable performance. In view of this, as shown in FIG. 4, which is another structural schematic diagram of an emission control circuit according to an embodiment of the present disclosure, the first transistor M1 and the second transistor M2 each can be set as a double-gate transistor. For a double-gate transistor, it has a large channel length, i.e., a small width-to-length ratio $$\frac{W}{L}.$$

According to a leakage current formula of $$I = \frac{1}{2}\mu_n C_{ox}\frac{W}{L}(V_{gs} - |V_{th}|)^2,$$

it can be seen that the smaller the width-to-length ratio $$\frac{W}{L}$$

is, the smaller the leakage current of the transistor is and the lower the concentration of active carriers is, which can improve performance stability of the transistor. Therefore, setting both the first transistor M1 and the second transistor M2 as a double-gate transistor can improve stability and compression resistant characteristics of the first transistor M1 and the second transistor M2. In this way, even if there is a big voltage difference between the first control signal terminal CK and the second node N2 in the fourth period t4, the first transistor M1 and the second transistor M2 can normally operate, thereby ensuring the operation stability of the emission control circuit.

Figure 5:
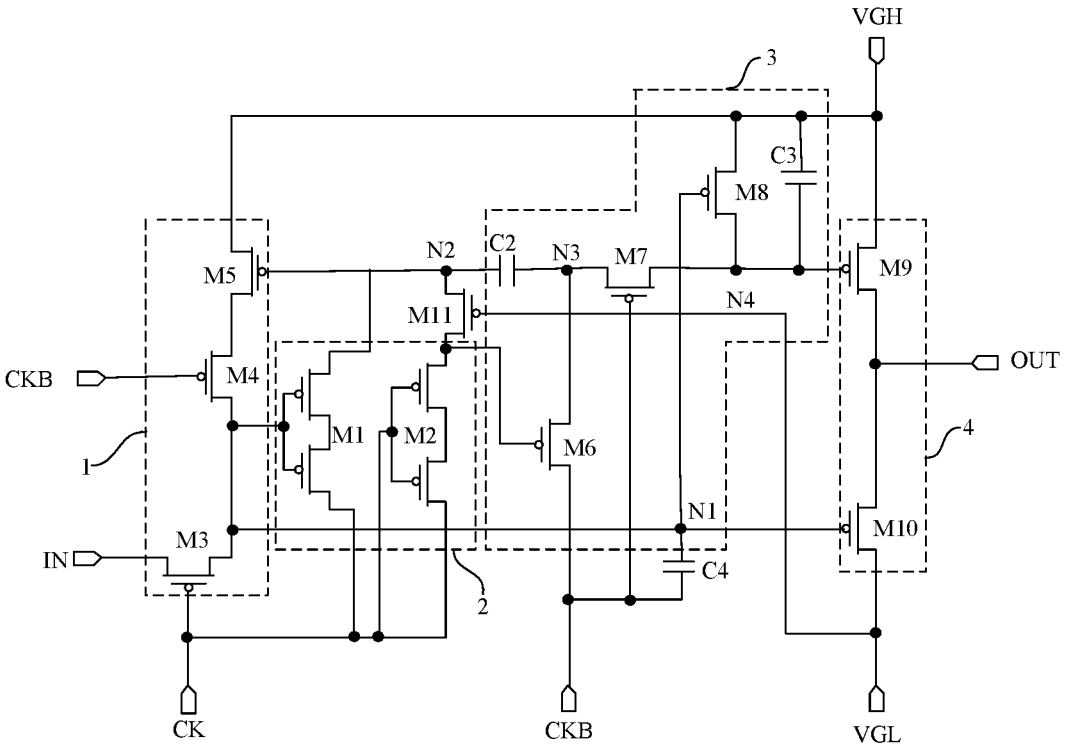
FIG. 5 is still another structural schematic diagram of an emission control circuit according to an embodiment of the present disclosure.

Further, as shown in FIG. 5, which is still another structural schematic diagram of an emission control circuit according to an embodiment of the present disclosure, the first electrode of the second transistor M2 is electrically connected to the second node N2 through an eleventh transistor M11. The eleventh transistor M11 has a first electrode electrically connected to the second node N2 and a second electrode electrically connected to the first electrode of the second transistor M2. The eleventh transistor M11 is maintained in a switched-on state.

When the eleventh transistor M11 in the switched-on state is connected between the second transistor M2 and the second node N2, the eleventh transistor M11 in the switched-on state can function for voltage division. In this way, a voltage at the first electrode of the second transistor M2 can be reduced in the fourth period t4, thereby reducing a voltage difference between two terminals of the second transistor M2. Thus, the second transistor M2 can operate stably.

In some embodiments, when the eleventh transistor M11 is a P-type transistor, referring to FIG. 5 again, a control electrode of the eleventh transistor M11 can be set to be electrically connected to the second voltage signal terminal VGL, so as to maintain the eleventh transistor M11 in the switched-on state.

Figure 6:
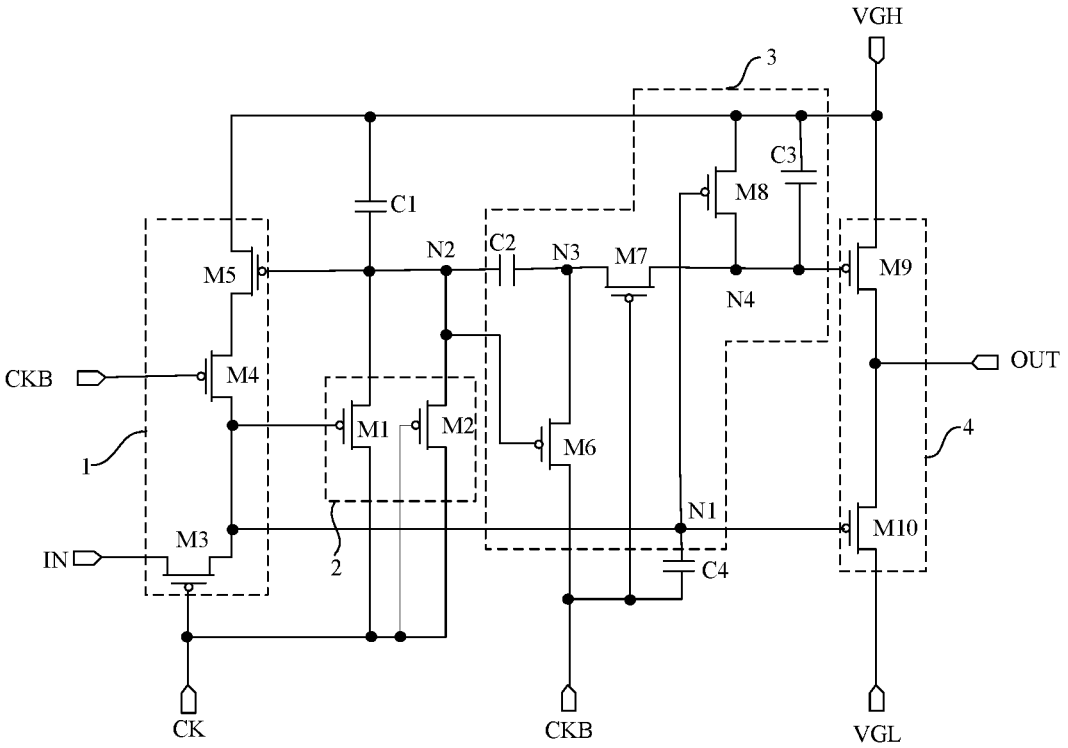
FIG. 6 is yet another structural schematic diagram of an emission control circuit according to an embodiment of the present disclosure.

Further, as shown in FIG. 6, which is yet another structural schematic diagram of an emission control circuit according to an embodiment of the present disclosure, the emission control circuit can further include a first capacitor C1. The first capacitor C1 has a first electrode electrically connected to the first voltage signal terminal VGH and a second electrode electrically connected to the second node N2.

It can be seen from the above description on the operating process of the emission control circuit that if the emission control circuit is not provided with the first capacitor C1, but only provided with the second capacitor C2, the potential at the second node N2 would be significantly influenced by the potential at the third node N3 in the fourth period t4, thereby leading to a great fall of the potential at the second node N2 in the fourth period t4 and further resulting in a big voltage difference between the first control signal terminal CK and the second node N2.

By adding the first capacitor C1, the potential at the second node N2 can be adjusted by means of a combined effect of the first capacitor C1 and the second capacitor C2. For example, at the time of entering the fourth period t4 from the third period t3, a potential variation of the third node N3 is $\Delta V_{N3}$, and a potential variation of the second node N2 is $$\Delta V_{N4} = \frac{C_2}{C_2 + C_1 + C_g} \times \Delta V_{N3}.$$

Upon comparing $\Delta V_{N4}$ with $\Delta V_{N4}'$, it can be seen that the potential variation of the second node N2 in the fourth period t4 is small after the first capacitor C1 is added. That is, the combined effect of the first capacitor C1 and the second capacitor C2 can reduce the influence of the potential variation of the third node N3 on the potential at the second node N2, such that there would be only a small fall in the potential at the second node N2 in the fourth period, thereby preventing the voltage difference between the first control signal terminal CK and the second node N2 from being too big and further improving stability of the first transistor M1 and the second transistor M2 in the fourth period t4 while improving operation stability of the emission control circuit.

Generally, when the voltage difference between two terminals of a transistor exceeds 20V, stability of the transistor would be greatly affected. In view of this, the embodiments of the present disclosure can set the capacitance of the first capacitor C1 in such a manner that the voltage difference between the second node N2 and the first control signal terminal CK is no more than 20V in the fourth period t4.

In some embodiments, the logic low level provided by the first control signal terminal CK, the logic low level provided by the second control signal terminal CKB and the logic low level provided by the input signal terminal IN have a same potential, and the logic high level provided by the first control signal terminal CK, the logic high level provided by the second control signal terminal CKB and the logic high level provided by the input signal terminal IN have a same potential. In this case, the first capacitor C1 has a capacitance $C_1$ satisfying:

$$C_1 \le \frac{C_2 \times (V_1 - V_2)}{-20 + V_2 - V_1 - |V_{th}|} - C_2 - C_g, \quad \text{Formula (1)}$$

where $C_2$ is a capacitance of the second capacitor C2, $C_g$ is a parasitic capacitance, $V_1$ is a potential of the logic low level, $V_2$ a potential of the logic high level, and $|V_{th}|$ is a threshold voltage of the second transistor M2.

The detailed analysis will be provided as follows.

In the third period, the third node N3 receives logic high level of a potential of $V_2$ provided by the second control signal terminal CBK, and the first node N1 receives logic high level of a potential of $V_2$ provided by the input signal terminal IN. The transistor M1 is switched off under the effect of the logic high level at the first node N1. The second transistor M2 is switched on under the effect of the logic low level provided by the first control signal terminal CK. The logic low level of a potential of $V_1$ provided by the first control signal terminal CK is transmitted to the second node N2 through the switched-on second transistor M2. It should be noted that based on the operating principle of a transistor, when the transistor is switched on, logic low level transmitted through a first electrode to a second electrode of the transistor has a potential subject to influence of a threshold voltage $V_{th}$ of the transistor. Hence, a signal received by the second node N2 has a potential of $V_1+|V_{th}|$.

In the fourth period, the potential at the third node N3 jumps from logic high level to logic low level, that is, $\Delta V_{N3}=V_1-V_2$. Moreover, due to $$\Delta V_{N2} = \frac{C_2}{C_2 + C_1 + C_g} \times \Delta V_{N3},$$

it can be deduced that $\Delta V_{N2} \ge -20+V_2-V_1-|V_{th}|$ by combining the formula (1). Since the potential at the second node N2 is $V_1+|V_{th}|$ in the third period, it can be deduced that the potential at the second node N2 in the fourth period is $V_{N2} \ge -20+V_2$ further based on $V_{N2}(V_1+|V_{th}|)=\Delta V_{N2}$. Moreover, since the first control signal terminal CK provides the logic high level of the potential of $V_2$ in the fourth period, the voltage difference between the first control signal terminal CK and the second node N2 is $\Delta V=V_2-V_{N2}$, i.e., $\Delta V \le 20V$.

Consequently, by making the capacitance $C_1$ of the first capacitor C1 satisfy the formula (1), the voltage difference between the first control signal terminal CK and the second node N2 can be allowed to be no more than 20V, such that the transistor and the circuit can operate stably.

Figure 7:
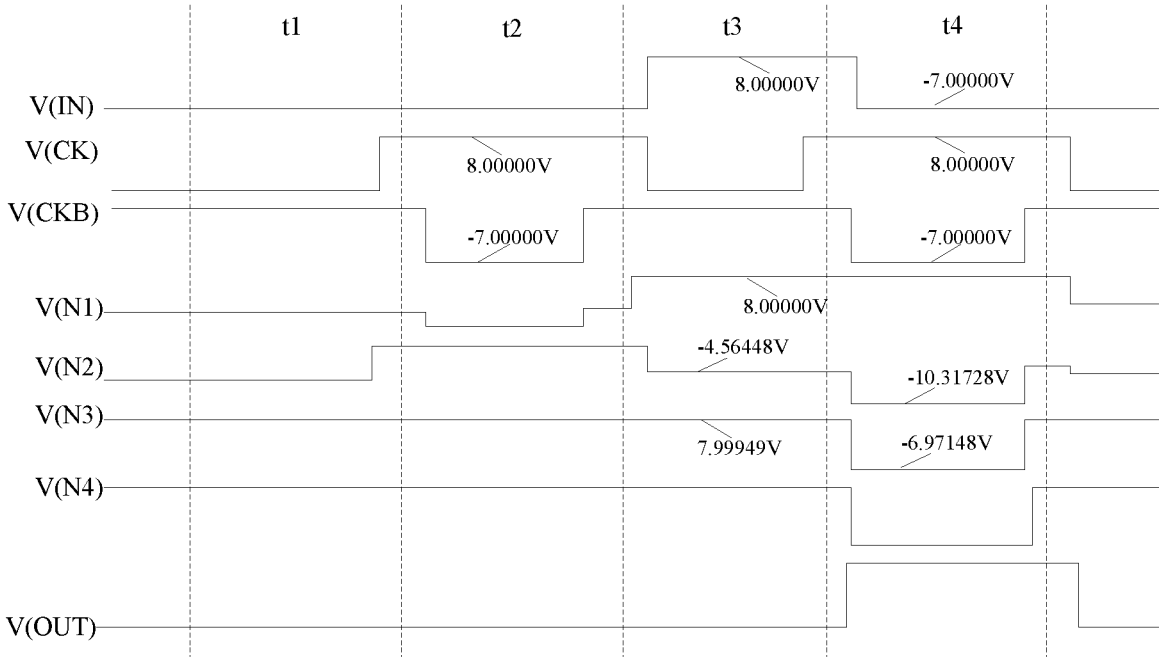
FIG. 7 is a simulation signal sequence diagram corresponding to FIG. 6.

FIG. 7 is a simulation signal sequence diagram corresponding to FIG. 6. The simulation has been performed on the emission control circuit based on the structural schematic diagram of the emission control circuit shown in FIG. 6, has taken $C_g$=60f, $C_2$=100f, $V_{th}$=−2.5V, $V_1$=−7V and $V_2$=8V as an example, and has set the capacitance $C_1$ of the first capacitor C1 as 50*f* according to the formula (1). As shown in FIG. 7, in the third period, the potential at the third node N3 is 7.99949V (approximate to 8V) and the potential at the second node N2 is −4.56448V (approximate to −4.5V), satisfying $V_1+|V_{th}|$. In the fourth period, the potential at the third node N3 is −6.97148V (approximate to −7V) and the potential at the second node N2 is −10.31728V (approximate to −10V), satisfying $V_{N2} \ge -20+V_2$. Moreover, in the fourth period, the voltage difference between the first control signal terminal CK and the second node N2 is 8V−(−10V)=18V, being stabilized to be no more than 20V.

Further, it can also be set that the capacitance $C_1$ of the first capacitor C1 can satisfy:

$$C_1 \ge \frac{C_2 \times (V_1 - V_2)}{-2|V_{th}|} - C_2 - C_g. \quad \text{Formula (2)}$$

The detailed analysis will be provided as follows.

In the fourth period, the potential variation of the third node N3 is $\Delta V_{N3}=V_1-V_2$. Moreover, due to $$\Delta V_{N2} = \frac{C_2}{C_2 + C_1 + C_g} \times \Delta V_{N3},$$

it can be deduced that $\Delta V_{N2} \le -2|V_{th}|$ by combining the formula (2). Since the potential at the second node N2 in the third period is $V_1+|V_{th}|$, it can be deduced that the potential at the second node N2 in the fourth period is $V_{N2} \le V_1-|V_{th}|$ further based on $V_{N2}-(V_1+|V_{th}|)=\Delta V_{N2}$. By setting $V_{N2} \le V_1-|V_{th}|$, this can allow the potential at the second node N2 in the fourth period to be lower than $V_1$, thereby improving capability of the logic low level at the second node N2 for driving the third processing module 3. This can further allow the third processing module 3 to operate normally, such that the logic low level provided by the second control signal terminal CKB can be more completely transmitted to the third node N3, thereby ensuring operation stability of the circuit.

In some embodiments, referring to FIG. 2 again, the output module 4 can include a ninth transistor M9 and a tenth transistor M10.

The ninth transistor M9 has a control electrode electrically connected to the fourth node N4, a first electrode electrically connected to the first voltage signal terminal VGH, and a second electrode electrically connected to the emission control signal terminal OUT. The ninth transistor M9 controls electrical connection between the first voltage signal terminal VGH and the emission control signal terminal OUT based on the fourth signal applied to the fourth node N4.

The tenth transistor M10 has a control electrode electrically connected to the first node N1, a first electrode electrically connected to the emission control signal terminal OUT, and a second electrode electrically connected to the second voltage signal terminal VGL. The tenth transistor M10 controls electrical connection between second voltage signal terminal VGL and the emission control signal terminal OUT based on the first signal applied to the first node N1.

In the following, referring to FIG. 6, the operating principles of respective transistors will be explained in detail by assuming that all transistors in the emission control circuit are P-type transistors.

In the first period t1, the input signal terminal IN provides logic low level, the first control signal terminal CK provides logic low level, and the second control signal terminal CKB provides logic high level. The third transistor M3 is switched on under the effect of the logic low level provided by the first control signal terminal CK, and then transmits the logic low level provided by the input signal terminal IN to the first node N1. The first transistor M1 is switched on under the effect of the logic low level at the first node N1. The second transistor M2 is switched on under the effect of the logic low level provided by the first control signal terminal CK. The first transistor M1 and the second transistor M2 transmit the logic low level provided by the first control signal terminal CK to the second node N2. The sixth transistor M6 is switched on under the effect of the logic low level at the first node N1, and then transmits the logic high level provided by the second control signal terminal CKB to the third node N3. The eighth transistor M8 is switched on under the effect of the logic low level at the first node N1, and then transmits the logic high level provided by the first voltage signal terminal VGH to the fourth node N4. The tenth transistor M10 is switched on under the effect of the logic low level at the first node N1, and then transmits the logic low level provided by the second voltage signal terminal VGL to the emission control signal terminal OUT, such that the emission control signal terminal OUT outputs logic low level.

In the second period t2, the input signal terminal IN provides logic low level, the first control signal terminal CK provides logic high level, and the second control signal terminal CKB provides logic low level. The first node N1 is maintained at logic low level. The first transistor M1 is maintained in a switched-on state, and transmits the logic high level provided by the first control signal terminal CK to the second node N2. The third node N3 is maintained at logic high level. The seventh transistor M7 is switched on under the effect of the logic low level provided by the second control signal terminal CKB, and then transmits the logic high level at the third node N3 to the fourth node N4. The eighth transistor M8 is maintained in a switched-on state, and transmits the logic high level provided by the first voltage signal terminal VGH to the fourth node N4. The tenth transistor M10 is maintained in a switched-on state, such that the emission control signal terminal OUT continuously outputs logic low level.

In the third period t3, the input signal terminal IN provides logic low level, the first control signal terminal CK provides logic low level, and the second control signal terminal CKB provides logic high level. The third transistor M3 is switched on under the effect of the logic low level provided by the first control signal terminal CK, and then transmits the logic high level provided by the input signal terminal IN to the first node N1. The second transistor M2 is switched on under the effect of the logic low level provided by the first control signal terminal CK, and then transmits the logic low level provided by the first control signal terminal CK to the second node N2. The sixth transistor M6 is switched on under the effect of the logic low level at the second node N2, and then transmits the logic high level provided by the second control signal terminal CKB to the third node N3. The emission control signal terminal OUT continuously outputs logic low level.

In the fourth period t4, the input signal terminal IN provides logic low level, the first control signal terminal CK provides logic high level, and the second control signal terminal CKB provides logic low level. The first node N1 is maintained at logic high level. The sixth transistor M6 is maintained in a switched-on state, and transmits the logic low level provided by the second control signal terminal CKB to the third node N3. The potential at the second node N2 is slightly pulled down by means of the combined effect of the first capacitor C1 and the second capacitor C2. The seventh transistor M7 is switched on under the effect of the logic low level provided by the second control signal terminal CKB, and then transmits the logic low level at the third node N3 to the fourth node N4. The ninth transistor M9 is switched on under the effect of the logic low level at the fourth node N4, and then transmits the logic high level provided by the first voltage signal terminal VGH to the emission control signal terminal OUT, such that the emission control signal terminal OUT outputs logic high level.

In the fifth period t5, the input signal terminal IN provides logic low level, the first control signal terminal CK provides logic low level, and the second control signal terminal CKB provides logic high level. The third transistor M3 is switched on under the effect of the logic low level provided by the first control signal terminal CK, and then transmits the logic low level provided by the input signal terminal IN to the first node N1. The first transistor M1 is switched on under the effect of the logic low level at the first node N1. The second transistor M2 is switched on under the effect of the logic low level provided by the first control signal terminal CK. The first transistor M1 and the second transistor M2 transmit the logic low level provided by the first control signal terminal CK to the second node N2. The sixth transistor M6 is switched on under the effect of the logic low level at the second node N2, and then transmits the logic high level provided by the second control signal terminal CKB to the third node N3. The eighth transistor M8 is switched on under the effect of the logic low level at the first node N1, and then transmits the logic high level provided by the first voltage signal terminal VGH to the fourth node N4. The tenth transistor M10 is switched on under the effect of the logic low level at the first node N1, and then transmits the logic low level provided by the second voltage signal terminal VGL to the emission control signal terminal OUT, such that the emission control signal terminal OUT outputs logic low level.

In the sixth period t6, the input signal terminal IN provides logic low level, the first control signal terminal CK provides logic high level, and the second control signal terminal CKB provides logic low level. The first transistor M1 is switched on under the effect of the logic low level at the first node N1, and then transmits the logic high level provided by the first control signal terminal CK to the second node N2. The seventh transistor M7 is switched on under the effect of the logic low level provided by the second control signal terminal CBK, and transmits the logic high level at the third node N3 to the fourth node N4. The tenth transistor M10 is maintained in a switched-on state, such that the emission control signal terminal OUT keeps outputting logic low level.

Further, referring to FIG. 6 again, the emission control circuit can further include a pull-down capacitor C4. The pull-down capacitor C4 has a first electrode electrically connected to the first node N1 and a second electrode electrically connected to the second voltage signal terminal VGL. In the case in which the emission control circuit includes the pull-down capacitor C4, in the second period, the pull-down capacitor C4 pulls down the potential at the first node N1 based on the logic low level provided by the second control signal terminal CKB, such that the potential at the first node N1 becomes lower. This can allow the tenth transistor M10 to be switched on more completely, thereby transmitting the logic low level provided by the second voltage signal terminal VGL to the emission control signal terminal OUT in a better way.

The embodiments of the present disclosure further provide a method for driving an emission control circuit. The method is applicable in the emission control circuit as mentioned above.

Referring to FIGS. 2 and 3, the method for driving the emission control circuit according to the embodiments of the present disclosure includes:

in a first period t1, the input signal terminal IN providing logic low level, the first control signal terminal CK providing logic low level, the second control signal terminal CKB providing logic high level, the first processing module 1 providing logic low level to the first node N1 in response to the logic low level provided by the first control signal terminal CK, the second processing module 2 providing logic low level to the second node N2 by the first transistor M1 of the second processing module 2 responding to the logic low level at the first node N1 and the second transistor M2 of the second processing module 2 responding to the logic low level provided by the first control signal terminal CK, the third processing module 3 providing logic high level to the third node N3 and provides logic high level to the fourth node N4 in response to the logic low level at the first node N1 and the logic low level at the second node N2, and the output module 4 enabling the emission control signal terminal OUT to output logic low level in response to the logic low level at the first node N1;

in a second period t2, the input signal terminal IN providing logic low level, the first control signal terminal CK providing logic high level, the second control signal terminal CKB providing logic low level, the second processing module 2 providing logic high level to the second node N2 by the first transistor M1 of the second processing module 2 responding to logic low level at the first node N1, the third processing module 3 providing logic high level to the fourth node N4 in response to the logic low level provided by the second control signal terminal CKB and the logic low level at the first node N1, and the output module 4 enabling the emission control signal terminal OUT to keep outputting logic low level in response to the logic low level at the first node N1;

in a third period t3, the input signal terminal IN providing logic low level, the first control signal terminal CK providing logic low level, the second control signal terminal CKB providing logic high level, the first processing module 1 providing logic high level to the first node N1 in response to the logic low level provided by the first control signal terminal CK, the second processing module 2 providing logic low level to the second node N2 by the second transistor M2 of the second processing module 2 responding to the logic low level provided by the first control signal terminal CK, the third processing module 3 providing logic high level to the third node N2, and the emission control signal terminal OUT keeping outputting logic low level;

in a fourth period t4, the input signal terminal IN providing logic low level, the first control signal terminal CK providing logic high level, the second control signal terminal CKB providing logic low level, the third processing module 3 providing logic low level to the third node N3 and providing logic low level to the fourth node N4 in response to logic low level at the second node N2 and the logic low level provided by the second control signal terminal CKB, and the output module 4 enabling the emission control signal terminal OUT to output logic high level in response to the logic low level at the fourth node N4;

in a fifth period t5, the input signal terminal IN providing logic low level, the first control signal terminal CK providing logic low level, the second control signal terminal CKB providing logic high level, the first processing module 1 providing logic low level to the first node N1 in response to the logic low level provided by the first control signal terminal CK, the second processing module 2 providing logic low level to the second node N2 by the first transistor M1 responding to the logic low level at the first node N1 and the second transistor M2 responding to the logic low level provided by the first control signal terminal CK, the third processing module 3 providing logic high level to the third node N3 and providing logic high level to the fourth node N4 in response to the logic low level at the second node N2 and the logic low level at the first node N1, and the output module 4 enabling the emission control signal terminal OUT to output logic low level in response to the logic low level at the first node N1; and in a sixth period t6, the input signal terminal IN providing logic low level, the first control signal terminal CK providing logic high level, the second control signal terminal CKB providing logic low level, the first transistor M1 providing logic high level to the second node N2 in response to logic low level at the first node N1, the third processing module 3 providing logic high level to the fourth node N4 in response to the logic low level at the first node N1, and the output module 4 enabling the emission control signal terminal OUT to keep outputting logic low level output in response to the logic low level at the first node N1.

The specific driving process of the emission driving circuit has been explained in detail in the above embodiments, and will not be repeated herein.

According to the method for driving the emission control circuit according to the embodiments of the present disclosure, in the sixth period t6, potentials at the two terminals of the second transistor M2 are both logic high level, such that the voltage difference between the two terminals of the second transistor M2 can be reduced, the stability of the second transistor M2 can be improved, the operation stability of the entire emission control circuit can be improved, and thus the image can be displayed normally.

Moreover, referring to FIG. 2 again, when the emission control circuit further includes the pull-down capacitor C4, the method for driving the emission control circuit can further include: the pull-down capacitor C2 pulling down a potential at the first node N1 based on the logic low level provided by the second control signal terminal CKB in the second period t2. In the second period t2, the pull-down capacitor C2 pulling down the potential at the first node N1 can make the potential at the first node N1 lower, such that the tenth transistor M10 can be switched on more completely, thereby transmitting the logic low level provided by the second voltage signal terminal VGL to the emission control signal terminal OUT in a better way.

Figure 8:
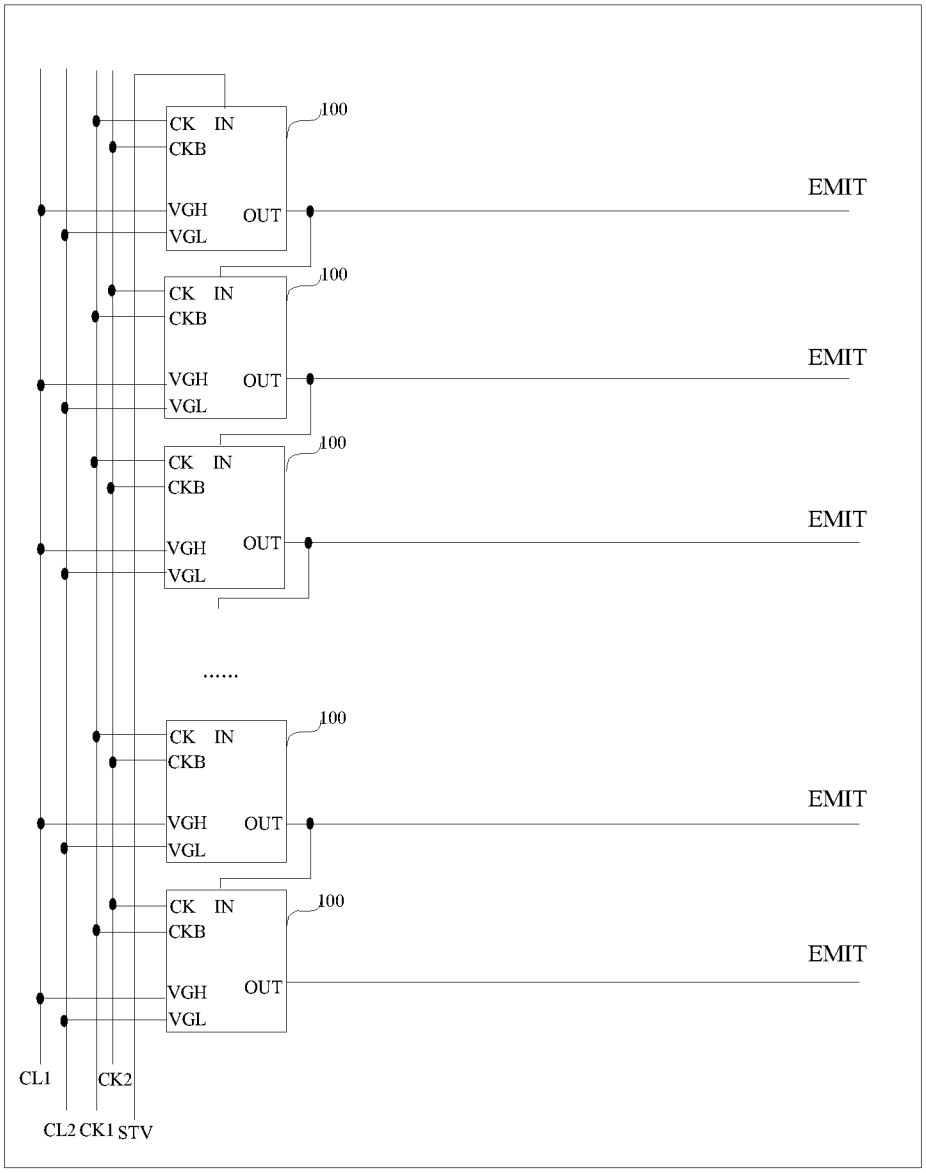
FIG. 8 is a structural schematic diagram of an emission controller according to an embodiment of the present disclosure.

The embodiments of the present disclosure further provide an emission controller. FIG. 8 is a structural schematic diagram of an emission controller according to an embodiment of the present disclosure. As shown in FIG. 8, the emission controller includes a plurality of cascaded emission control circuits 100 as described above.

Since the emission controller according to the embodiments of the present disclosure includes the abovementioned emission control circuit 100, the use of such emission controller can reduce the voltage difference between two terminals of a transistor in the emission control circuit 100, improve stability of the transistor and further improve operation stability of the entire emission control circuit, such that the image can be normally displayed.

Referring to FIG. 8 again, each odd-numbered emission control circuit 100 of the plurality of cascaded emission control circuits 100 has a first control signal terminal CK electrically connected to a first clock signal line CK1 and a second control signal terminal CKB electrically connected to a second clock signal line CK2. Each even-numbered emission control circuit 100 of the plurality of cascaded emission control circuits has a first control signal terminal CK electrically connected to the second clock signal line CK2 and a second control signal terminal CKB electrically connected to the first clock signal line CK1.

Moreover, among the plurality of cascaded emission control circuits 100, an emission control signal terminal OUT of one emission control circuit 100 is electrically connected to an input signal terminal IN of another emission control circuit 100 following the one emission control circuit 100. Moreover, the first emission control circuit 100 has an input signal terminal IN electrically connected to a frame stating signal line STV.

Further, each emission control circuit 100 has a first voltage signal terminal VGH electrically connected to a first voltage signal line CL1, and a second voltage signal terminal VGL electrically connected to a second voltage signal line CL2.

With the above connection manners, taking the first emission control circuit 100 and the second emission control circuit 100 as an example, the first control signal terminal CK of the first emission control circuit 100 is electrically connected to the first clock signal line CK1 and the second control signal terminal CKB of the first emission control circuit 100 is electrically connected to the second clock signal line CK2, and the first control signal terminal CK of the second emission control circuit 100 is electrically connected to the second clock signal line CK2 and the second control signal terminal CKB of the second emission control circuit 100 is electrically connected to the first clock signal line CK1.

From the above descriptions on the operating principles of the emission control circuit 100 according to the embodiments of the present disclosure, it can be seen that each emission control circuit 100 includes a driving cycle including six periods. When the first emission control circuit 100 is in the second period, the input signal terminal IN of the first emission control circuit 100 provides logic low level, the first control signal terminal CK of the first emission control circuit 100 receives logic high level provided by the first clock signal line CK1, and the second control signal terminal CKB of the first emission control circuit 100 receives logic low level provided by the second clock signal line CK2. Meanwhile, the logic low level outputted by the emission control signal terminal OUT of the first emission control circuit 100 is transmitted to an input signal terminal IN of the second emission control circuit 100. Based on the connection relationships among the first and second control signal terminals CK, CKB of the second emission control circuit 100 and the first and second clock signal lines CK1, CK2, in this period, the first control signal terminal CK of the second emission control circuit 100 receives the logic low level provided by the second clock signal line CK2 and the second control signal terminal CKB of the second emission control circuit 100 receives the logic high level provided by the first clock signal line CK1. At this time, the second emission control circuit 100 is in the first period. Accordingly, with the connection relationships among the plurality of emission control circuits 100 according to the embodiment of the present disclosure, the plurality of emission control circuits 100 can be allowed to sequentially output an emission control signal.

Figure 9:
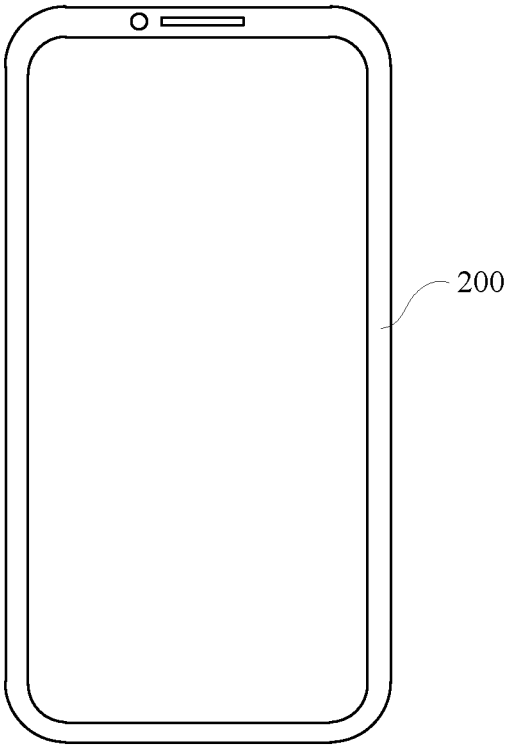
FIG. 9 is a structural schematic diagram of display device according to an embodiment of the present disclosure.

The embodiments of the present disclosure further provide a display device. FIG. 9 is a structural schematic diagram of display device according to an embodiment of the present disclosure. The display device includes the emission controller 200 as mentioned above. The specific structure of the emission controller 200 has been explained in detail in the above embodiments, and will not be repeated herein. It should be noted that, the display device shown in FIG. 9 is merely illustrative, and the display device may be any electronic device having a display function, such as a cellphone, a tablet computer, a notebook computer, an electronic book, or a television, etc.

As the display device according to the embodiments of the present disclosure includes the abovementioned emission controller 200, the use of such display device can improve operation stability of the emission control circuit 100 in the emission controller 200, thereby improving display performance of the display device.

The above-described embodiments are merely some embodiments of the present disclosure and are not intended to limit the present disclosure. Any modification, equivalent substitution and improvement made within the principle of the present disclosure shall fall into the protection scope of the present disclosure.

What is claimed is:

1. An emission control circuit, comprising:

a first processing module electrically connected to an input signal terminal, a first control signal terminal, a second control signal terminal and a first voltage signal terminal and configured to generate a first signal to be outputted to a first node in response to a first control signal, a second control signal and a second signal;

a second processing module electrically connected between the first control signal terminal and a second node and configured to generate the second signal to be outputted to the second node in response to the first signal and the first control signal, wherein the second processing module comprises a first transistor and a second transistor, wherein the first transistor has a control electrode electrically connected to the first node, a first electrode electrically connected to the second node, and a second electrode electrically connected to the first control signal terminal, and wherein the second transistor has a control electrode electrically connected to the first control signal terminal, a first electrode electrically connected to the second node, and a second electrode electrically connected to the first control signal terminal;

a third processing module electrically connected to the second control signal terminal and the first voltage signal terminal and configured to generate a third signal to be outputted to a third node and to generate a fourth signal to be outputted to a fourth node in response to the second control signal, the first signal and the second signal; and an output module electrically connected to the first voltage signal terminal, a second voltage signal terminal, and an emission control signal terminal and configured to provide an emission control signal to the emission control signal terminal in response to the first signal and the fourth signal, wherein the output module comprises:

a ninth transistor having a control electrode electrically connected to the fourth node, a first electrode electrically connected to the first voltage signal terminal, and a second electrode electrically connected to the emission control signal terminal; and a tenth transistor having a control electrode electrically connected to the first node, a first electrode electrically connected to the emission control signal terminal, and a second electrode electrically connected to the second voltage signal terminal.

2. The emission control circuit according to claim 1, wherein the first processing module comprises:

a third transistor having a control electrode electrically connected to the first control signal terminal, a first electrode electrically connected to the first node, and a second electrode electrically connected to the input signal terminal;

a fourth transistor having a control electrode electrically connected to the second control signal terminal, a first electrode, and a second electrode electrically connected to the first node; and a fifth transistor having a control electrode electrically connected to the second node, a first electrode electrically connected to the first voltage signal terminal, and a second electrode electrically connected to the first electrode of the fourth transistor.

3. The emission control circuit according to claim 1, wherein the third processing module comprises:

a sixth transistor having a control electrode electrically connected to the second node, a first electrode electrically connected to the third node, and a second electrode electrically connected to the second control signal terminal;

a seventh transistor having a control electrode electrically connected to the second control signal terminal, a first electrode electrically connected to the third node, and a second electrode electrically connected to the fourth node;

an eighth transistor having a control electrode electrically connected to the first node, a first electrode electrically connected to the first voltage signal terminal, and a second electrode electrically connected to the fourth node;

a storage capacitor having a first electrode electrically connected to the first voltage signal terminal and a second electrode electrically connected to the fourth node; and a second capacitor having a first electrode electrically connected to the second node and a second electrode electrically connected to the third node.

4. The emission control circuit according to claim 1, wherein the emission control circuit further comprises:

a first capacitor having a first electrode electrically connected to the first voltage signal terminal and a second electrode electrically connected to the second node.

5. The emission control circuit according to claim 4, wherein a logic low level provided by the first control signal terminal, a logic low level provided by the second control signal terminal and a logic low level provided by the input signal terminal have a same potential, and a logic high level provided by the first control signal terminal, a logic high level provided by the second control signal terminal and a logic high level provided by the input signal terminal have a same potential;

wherein the first capacitor has a capacitance $C_1$ satisfying:

$$C_1 \leq \frac{C_2 \times (V_1 - V_2)}{-20 + V_2 - V_1 - |V_{th}|} - C_2 - C_g,$$

wherein $C_2$ is a capacitance of the second capacitor, $C_g$ is a parasitic capacitance, $V_1$ is a potential of the logic low level, $V_2$ a potential of the logic high level, and $|V_{th}|$ is a threshold voltage of the second transistor.

6. The emission control circuit according to claim 5, wherein a capacitance of the first capacitor is $C_1$, and $C_1$ further satisfies:

$$C_1 \geq \frac{C_2 \times (V_1 - V_2)}{-2|V_{th}|} - C_2 - C_g.$$

7. The emission control circuit according to claim 1, wherein each of the first transistor and the second transistor is a double-gate transistor.

8. The emission control circuit according to claim 1, wherein the first electrode of the second transistor is electrically connected to the second node through an eleventh transistor, and the eleventh transistor maintains a switched-on state.

9. The emission control circuit according to claim 1, further comprising:

a pull-down capacitor having a first electrode electrically connected to the first node and a second electrode electrically connected to the second voltage signal terminal.

10. A display device, comprising the emission control circuit according to claim 1.

11. A method for driving an emission control circuit, wherein the emission control circuit comprises:

a first processing module electrically connected to an input signal terminal, a first control signal terminal, a second control signal terminal and a first voltage signal terminal and configured to generate a first signal to be outputted to a first node in response to a first control signal, a second control signal and a second signal;

a second processing module electrically connected between the first control signal terminal and a second node and configured to generate the second signal to be outputted to the second node in response to the first signal and the first control signal, wherein the second processing module comprises a first transistor and a second transistor, wherein the first transistor has a control electrode electrically connected to the first node, a first electrode electrically connected to the second node, and a second electrode electrically connected to the first control signal terminal, and wherein the second transistor has a control electrode electrically connected to the first control signal terminal, a first electrode electrically connected to the second node, and a second electrode electrically connected to the first control signal terminal;

a third processing module electrically connected to the second control signal terminal and the first voltage signal terminal and configured to generate a third signal to be outputted to a third node and generate a fourth signal to be outputted to a fourth node in response to the second control signal, the first signal and the second signal; and an output module electrically connected to the first voltage signal terminal, a second voltage signal terminal, and an emission control signal terminal and configured to provide an emission control signal to the emission control signal terminal in response to the first signal and the fourth signal;

wherein the method comprises:

in a first period, providing a logic low level by the input signal terminal, providing a logic low level by the first control signal terminal, providing a logic high level by the second control signal terminal, providing, by the first processing module, a logic low level to the first node in response to the logic low level provided by the first control signal terminal, providing, by the second processing module, a logic low level to the second node by the first transistor of the second processing module responding to logic low level at the first node and the second transistor of the second processing module responding to the logic low level provided by the first control signal terminal, providing, by the third processing module, logic high level to the third node and providing logic high level to the fourth node in response to the logic low level at the first node and logic low level at the second node, and enabling, by the output module, the emission control signal terminal to output logic low level in response to the logic low level at the first node;

in a second period, providing a logic low level by the input signal terminal, providing a logic high level by the first control signal terminal, providing a logic low level by the second control signal terminal, providing, by the second processing module, a logic high level to the second node by the first transistor of the second processing module responding to logic low level at the first node, providing, by the third processing module, a logic high level to the fourth node in response to the logic low level provided by the second control signal terminal and logic low level at the first node, and enabling, by the output module, the emission control signal terminal to keep outputting a logic low level in response to the logic low level at the first node;

in a third period, providing a logic low level by the input signal terminal, providing a logic low level by the first control signal terminal, providing logic high level by the second control signal terminal, providing, by the first processing module, a logic high level to the first node in response to the logic low level provided by the first control signal terminal, providing, by the second processing module, a logic low level to the second node by the second transistor of the second processing module responding to the logic low level provided by the first control signal terminal, providing, by the third processing module, a logic high level to the third node in response to the logic low level at the second node, and the emission control signal terminal keeping outputting a logic low level;

in a fourth period, providing a logic low level by the input signal terminal, providing a logic high level by the first control signal terminal, providing a logic low level by the second control signal terminal, providing, by the third processing module, a logic low level to the third node and providing a logic low level to the fourth node in response to a logic low level at the second node and the logic low level provided by the second control signal terminal, and enabling, by the output module, the emission control signal terminal to output a logic high level in response to the logic low level at the fourth node;

in a fifth period, providing a logic low level by the input signal terminal, providing a logic low level by the first control signal terminal, providing a logic high level by the second control signal terminal, providing, by the first processing module, a logic low level to the first node in response to the logic low level provided by the first control signal terminal, providing, by the second processing module, a logic low level to the second node by the first transistor responding to the logic low level at the first node and the second transistor responding to the logic low level provided by the first control signal terminal, providing, by the third processing module, a logic high level to the third node and providing a logic high level to the fourth node in response to the logic low level at the second node and the logic low level at the first node, and enabling, by the output module, the emission control signal terminal to output a logic low level in response to the logic low level at the first node; and in a sixth period, providing a logic low level by the input signal terminal, providing a logic high level by the first control signal terminal, providing a logic low level by the second control signal terminal, providing, by the first transistor, a logic high level to the second node in response to the logic low level at the first node, providing, by the third processing module, a logic high level to the fourth node in response to the logic low level at the first node, and enabling, by the output module, the emission control signal terminal to keep outputting a logic low level in response to the logic low level at the first node.

12. The method according to claim 11, wherein the emission control circuit further comprises a pull-down capacitor having a first electrode electrically connected to the first node and a second electrode electrically connected to the second voltage signal terminal, and wherein in the second period, the method further comprises: pulling down, by the pull-down capacitor, a potential at the first node based on the logic low level provided by the second control signal terminal.

13. An emission control circuit, comprising:

a first processing module electrically connected to an input signal terminal, a first control signal terminal, a second control signal terminal and a first voltage signal terminal and configured to generate a first signal to be outputted to a first node in response to a first control signal, a second control signal and a second signal;

a second processing module electrically connected between the first control signal terminal and a second node and configured to generate the second signal to be outputted to the second node in response to the first signal and the first control signal, wherein the second processing module comprises a first transistor and a second transistor, wherein the first transistor has a control electrode electrically connected to the first node, a first electrode electrically connected to the second node, and a second electrode electrically connected to the first control signal terminal, and wherein the second transistor has a control electrode electrically connected to the first control signal terminal, a first electrode electrically connected to the second node, and a second electrode electrically connected to the first control signal terminal;

a third processing module electrically connected to the second control signal terminal and the first voltage signal terminal and configured to generate a third signal to be outputted to a third node and to generate a fourth signal to be outputted to a fourth node in response to the second control signal, the first signal and the second signal; and an output module electrically connected to the first voltage signal terminal, a second voltage signal terminal, and an emission control signal terminal and configured to provide an emission control signal to the emission control signal terminal in response to the first signal and the fourth signal, wherein each of the first transistor and the second transistor is a double-gate transistor.

14. A display device, comprising the emission control circuit according to claim 13.

* * * * *